United States Patent [19]

Troutner et al.

[11] Patent Number: 4,872,299

[45] Date of Patent: Oct. 10, 1989

[54] KEY CLIP SUPPORT MEMBER

[75] Inventors: Arthur L. Troutner; Kevin B. O'Sullivan, both of Boise, Id.

[73] Assignee: Trus Joist Corporation

[21] Appl. No.: 290,686

[22] Filed: Dec. 27, 1988

[51] Int. Cl.[4] ..... F04C 3/12

[52] U.S. Cl. ..... 52/693

[58] Field of Search ..... 52/693, 692, 696, 694

[56] References Cited

U.S. PATENT DOCUMENTS

| | | | |
|---|---|---|---|
| 3,268,251 | 8/1966 | Troutner . | |
| 3,537,224 | 11/1970 | Troutner . | |
| 3,570,204 | 3/1971 | Birkemier . | |
| 3,591,995 | 7/1971 | Troutner . | |
| 4,003,179 | 1/1977 | Gilb | 52/693 |
| 4,007,573 | 2/1977 | Gilb . | |
| 4,068,442 | 1/1978 | Troutner . | |
| 4,069,635 | 1/1978 | Gilb . | |
| 4,104,843 | 8/1978 | Gilb . | |

*Primary Examiner*—John E. Murtagh
*Attorney, Agent, or Firm*—Kolisch, Hartwell & Dickinson

[57] ABSTRACT

The present invention provides a support member for use with a truss having upper and lower chords with web members extending therebetween. The chords have staggered recesses, and the web members have flattened ends which overlap within the support member. The support member includes a plurality of cases, with one such web case positioned in each of the recesses. Each web case includes a pair of opposed case elements, one of which is positioned to each side of the flattened web member ends, and wherein each case element includes a planar side portion having an interior edge facing the opposing chord, and a flange portion extending normally outwardly from the interior edge. The support member also includes a joining member for joining the web case to the adjacent web member ends. Also included in the support member is at least one case-retaining clip having a substantially planar flange and a tab extending normal to the planar flange, the tab being sized in width to be clearance receivable in the width of one of the recesses. The tab further includes a first portion of sufficient length to extend through the chord, and a second portion of sufficient length to secure the web case to the chord by bending of the second portion around the flange portion.

16 Claims, 1 Drawing Sheet

KEY CLIP SUPPORT MEMBER

BACKGROUND OF THE INVENTION

This invention relates to composite trusses used for supporting floors, roofs and other structural components, and particularly relates to a key clip support member which is used to connect the chords and webs of the truss.

Prior art trusses have been assembled by forming a web, generally of metal composition, in a zig-zag pattern and securing the webs to elongate chords, usually by means of forming a notch or recess in the chord and securing the web to the chords by means of a pin which extends laterally through the chord and web. This configuration produces a truss which is of diminished structural integrity due to the holes which are drilled to receive the pins.

Another form of connecting a web to a chord is disclosed in U.S. Pat. No. 3,537,224 to Troutner, wherein the webs are attached to a case which is received in a substantially rectangular recess formed in the chord. The case includes flanges which contact two sides of the chord, securing the web to the chord without the necessity of drilling a hole through the chord.

Although the case-enclosed web is suitable for its intended purpose, the cases formed on the web require strengthening to prevent buckling during loading. Although the cases are not structurally complex, their manufacturing process involves more distinct steps than desired. Additionally, the flanges which secure the web to the exterior side of the chords are restricted in size due to the assembly procedures which required the flange to pass through the recess formed in the chord.

It is therefore an object of the present invention to overcome the drawbacks and limitations with the prior art proposals. More specifically the invention has the following objects:

(1) to provide a key clip truss wherein a case-retaining clip is provided to secure a case to a chord;

(2) to develop a case-retaining clip which includes a flange of relatively large surface area on the exterior side of a chord;

(3) the provision of a web case which is easily and inexpensively constructed and which has a high decree of structural integrity; and (4) to provide a composite truss which has increased load bearing capability without requiring an increase in the thickness of the chords or the webs.

SUMMARY OF THE INVENTION

The present invention provides a support member for use with a truss having upper and lower chords with web members extending therebetween. The chords have staggered recesses, with each recess having a predetermined length and width and extending completely through the height of the chord. The web members have flattened ends which overlap within the support member. The support member includes a plurality of cases, with one such web case positioned in each of the recesses. Each web case includes a pair of opposed case elements, one of which is positioned to each side of the flattened web member ends, and wherein each case element includes a planar side portion having an interior edge facing the opposing chord, and a flange portion extending normally outwardly from the interior edge. The support member also includes joining means for joining the web case to the adjacent web member ends. Also included in the support member is at least one case-retaining clip having a substantially planar flange and a tab extending normal to the planar flange, with the tab being sized in width to be clearance receivable in the width of one of the recesses. The tab further includes a first portion of sufficient length to extend through the chord, and a second portion of sufficient length to secure the web case to the chord by bending of the second portion around the flange portion. The planar flange is normally wider than the recess into which its associated tab is receivable. Normally, two such clips are provided, one at each end of each recess. The clips can normally be described as being "independent" in that they are not formed as part of another member such as the case.

Another way to define the invention is a truss which includes the support members described above. In such a truss, it is normal that the web cases are insertable from a side of the chord which faces the other chord. The case-retaining clips are to be inserted into the recesses from an opposite side of the chord, which faces away from the opposing chord.

These and other objects and advantages of the invention will become more fully apparent as the description which follows is read in conjunction with the drawings.

DETAILED DESCRIPTION OF THE PREFERRED EMBODIMENT

Figure 1:
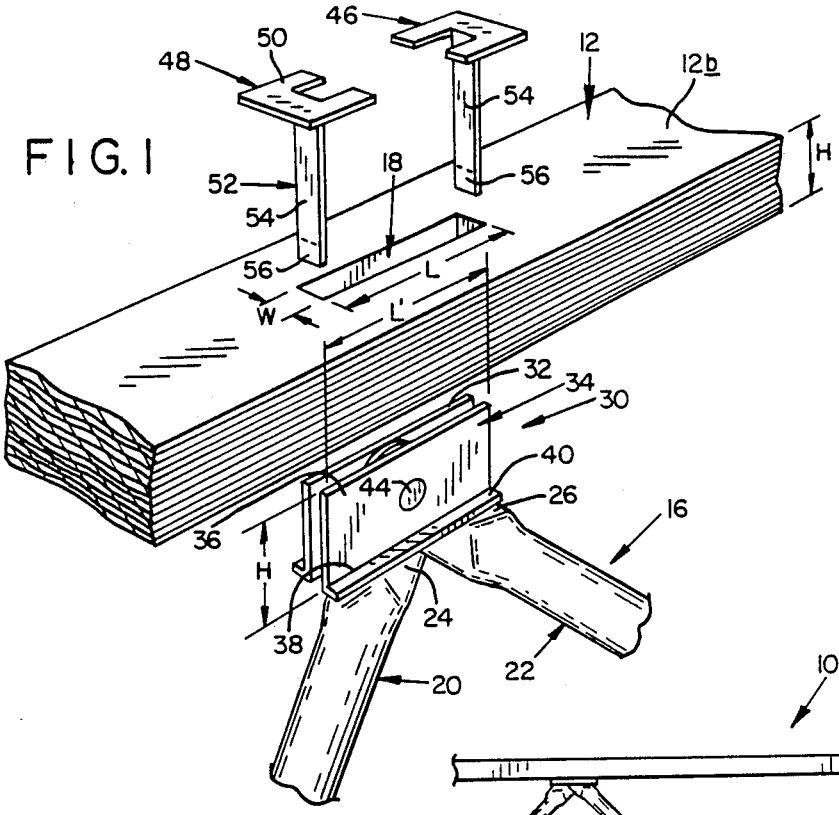
FIG. 1 is a perspective view of the key clip and case of the invention.
Figure 2:
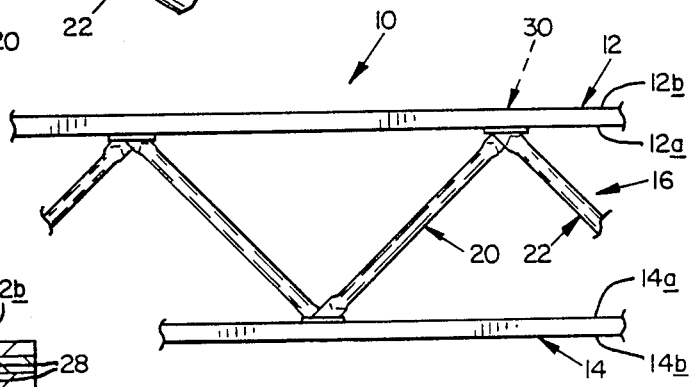
FIG. 2 is a reduced-size side elevation view of a truss constructed according to the invention.

Referring now to the drawings, and initially to FIGS. 1 and 2, a truss constructed according to the invention is shown generally at 10. Truss 10 includes an elongate upper chord 12 and an elongate lower chord 14. A web, shown generally at 16 extends between the upper and lower chords 12 and 14 and is joined thereto by a mechanism which will be described below.

Chords 12 and 14 have what is referred to herein as interior surfaces **12*a*, 14*a* which face one another, and exterior surfaces 12*b*, 14*b*, respectively. Chords 12 and 14**, in the preferred embodiment are formed of laminated veneer lumber (LVL) which is assembled by methods known to those skilled in the art. LVL provides a chord having more uniform and more predictable strength than lumber and may be formed in a variety of sizes to provide requisite structural strength.

The opposing chords 12, 14 have staggered recesses, such as recess 18 which extend through the height (H) of the chord, and which also has predetermined length (L) and width (W). The recesses extend along the major axes of the chords, which is normally generally horizontal or laterally extending.

Figure 4:
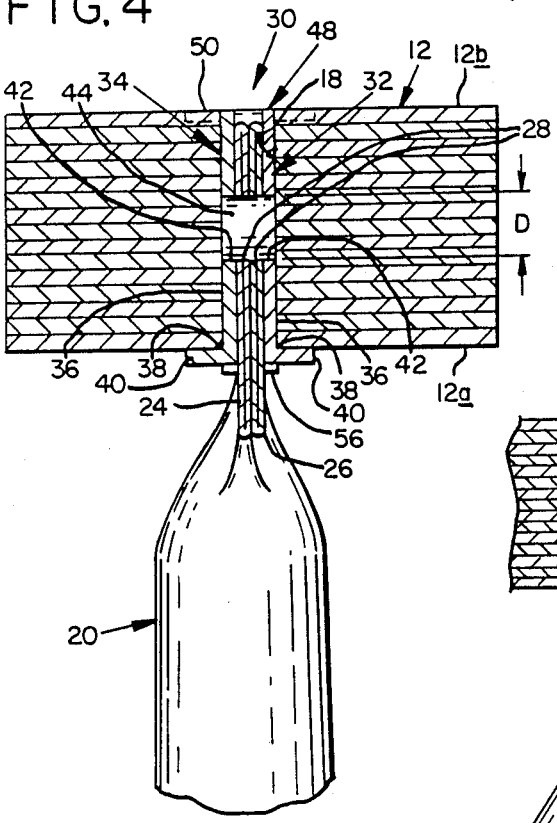
FIG. 4 is a cross section of the support member, taken generally along the line 4—4 of FIG. 3.
Figure 3:
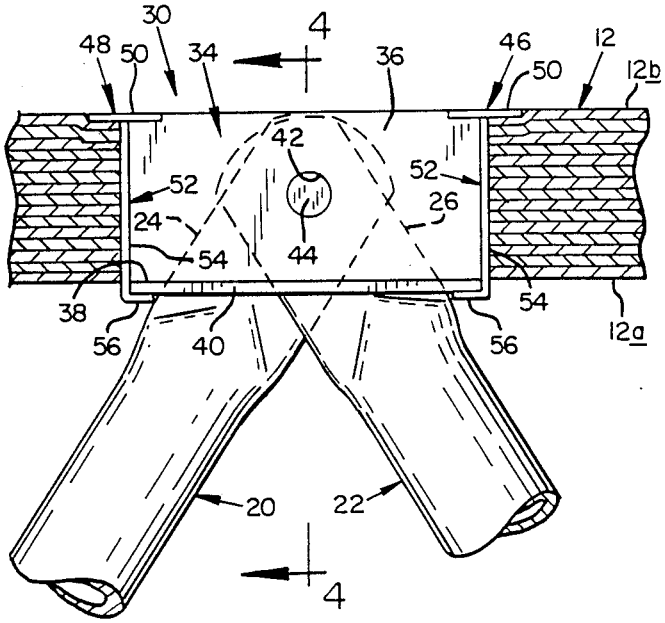
FIG. 3 is an enlarged side elevation view of the support member of the invention, with portions broken away to show detail.

Referring now to FIGS. 1–4, web 16 includes plural, elongate web links, such as 20, 22. In the preferred embodiment, the links are formed of tubular metal having flattened ends 24, 26, respectively. A bore 28 is formed in each flattened end and has a diameter (D). The web links 20, 22 are arranged diagonally between the chords 12, 14 and the ends of adjacent links are overlapped, as depicted in FIGS. 3 and 4, with the bores 28 thereof in an aligned condition.

Web cases 30 are provided to secure the ends of the web links 20, 22. Each web case 30 includes a pair of opposed case elements 32, 34. Each case element, such as case element 34, includes a planar side portion 36 which has a height dimension H equal to dimension H of the chords 12, 14, and a length L', which is less than length dimension L of recess 18.

Each case element has an interior edge 38, which, with the truss assembled, faces the opposing chord. A flange portion 40 extends normally outwardly from the interior edge of each side portion 36 and contacts the interior surfaces **12*a*, 14*a* of the chords 12, 14**.

Side portions 36 include a bore 42 formed therein. Joining means are provided for joining the web case 30 to adjacent link ends 24, 26. In the preferred embodiment, joining means takes the form of a case pin 44 which is inserted through bores 42 in case elements 32, 34 and bores 28 in links 20, 22. The case pin 44 is then swaged into position, thereby locking the links and case elements together. With the case elements and the web links joined together, a structure is formed which has a width W which is equal to the width W of recess 18. The links are thus secured to the web case between the case elements thereof, serving to space the case elements apart from one another to provide a structure which completely fills the width of the recess into which it is received.

In the preferred embodiment the case elements 32, 34 are formed of material which has first predetermined thickness. This material may be sheet metal or metal formed in a suitable casting.

To form the truss of the invention, the chords 12, 14 are prepared in the proper dimensions and recesses 18 are formed, as by mortising. The web 16 is formed with a web case 30 formed at the ends of adjacent web links 20, 22. The chords and web links are then assembled with a web case 30 received in each recess 18 of a chord. Web cases 30 are secured to chords 12 and 14 by means of case-retaining clips, such as clips 46, 48 Each clip includes a substantially planar flange 50 which is formed with a predetermined surface area. A tab 52 extends normal to the flange 50. The tab 52 has a width which is equal to that of recess 18 and is clearance receivable therein. A first portion 54 of the tab 52 has sufficient length to extend through the chord 12 or 14 while a second portion 56 has sufficient length to secure web case 30 to the chord when the second portion is bent over the flange portions 40 of case elements 32, 34. The fact that clips 46, 48 are independent makes it possible in the assembly process to insert the web case 30 in which the flattened ends 24, 26 are mounted, into the recesses 18 from the interior surfaces **12*a*, 14*a* of chords 12, 14, while the clips 46, 48 are inserted into the recess from the exterior surfaces 12*b*, 14*b*. Thus, the planar flange 50** may be larger and thereby provide more surface area than if it has to be inserted through the recess as a part of the web case, as is necessary with prior art proposals.

As depicted in FIGS. 3 and 4, the clips 46, 48 are typically pressed into the chord 50 such that they end up being countersunk and flush with the surface of the chord. This enables flooring (not shown) or other structural members to be placed directly over the chords 12 without the clips 46, 48 protruding. It also ensures a tight fit of the entire web case 30 and preloads, to a certain extent, flanged portions 40 against chord surface **12*a***.

In the preferred embodiment, clips 46, 48 are formed of material, such as sheet metal, which has a thickness which is less than that of the thickness from which the case elements are formed. The thickness (T) of the clips, also referred to herein as a second thickness, is used along with case element length L' to determine the length, L, of recess 18. L is determined by the relationship:

$$L = L' + 2T$$

With the web cases 30 received in the chord recesses 18, and the case-retaining clips 46, 48 inserted at either end of the web case and bent over, as depicted in FIGS. 3 and 4, a truss is formed which has the web 16 securely fixed to the chords 12, 14 such that any forces which are parallel to that of the grain of the LVL forming the chords is transmitted to the retaining clips 46, 48. These forces are then passed to the web case 30 and are evenly distributed through the truss. The primary loading perpendicular to the chords in a downward direction, is transmitted to the truss by the heavy flange portion 40. Clips 46, 48 provide resistance to any upward loading perpendicular to the chords in that the web cases are securely fixed to the chord by means of flange portions 40, case retaining clip flanges 50 and second portions 56.

The invention is not restricted to the particular embodiments which have been described, since variations may be made therein without departing from the scope of the invention as defied in the appended claims.

It is claimed and desired to be secured as Letters Patent:

1. A support member for use with a truss having upper and lower chords, wherein the chords have staggered recesses therein, each recess having a predetermined length and width and extending completely through the height of the chord, the truss further having diagonally extending web members with flattened ends overlapped within the support member, the web members extending between the chords to provide support thereto, wherein the support member comprises:

plural web cases located one in each said recess, each web case including a pair of opposed case elements one of which is positioned to each side of the adjacent flattened web member ends wherein each case element includes a planar side portion having an interior edge facing the opposing chord and a flange portion extending normally outwardly from said interior edge;

joining means for joining each of said web cases to adjacent web member ends; and at least one case-retaining clip, having a substantially planar flange and a tab extending normal to said planar flange, said tab being sized in width to be clearance receivable in the width of one of the recesses and having a first portion of sufficient length to extend through the chord and having a second portion of sufficient length to secure said web case to the chord by bending of said second portion over said flange portion.

2. The support member of claim 1 wherein said clip is independent.

3. The support member of claim 1 wherein said case elements are formed from material having a first thickness and said clips are formed of material having a second thickness which is less than that of said first thickness.

4. The support member of claim 1 further comprising a second clip.

5. The support member of claim 4 wherein said case element side portions are sized to be clearance receivable in the length of one of the recesses, with one of said clips located at each end of said side portion.

6. The support member of claim 1 wherein each of said side portions has a bore therethrough, each of said web member ends has a bore therethrough, and wherein said joining means includes a case pin which is inserted through said bores said case pin being of a length to locate both ends thereof flush with the outer surfaces of said side portions.

7. The support member of claim 1 wherein said case pin is swaged into said side portions.

8. The support member of claim 1 wherein each of said flanges is wider than the recess in which its associated tab is received.

9. A support member for use with a truss having upper and lower chords, wherein the chords have staggered recesses therein, each recess having a predetermined length and width and extending completely through the height of the chord, the truss further having diagonally extending web members with flattened ends overlapped within the support member, the web members extending between the chords to provide support thereto, wherein the support member comprises:

plural web cases located one in each said recess, each web case including a pair of opposed case elements one of which is positioned to each side of the adjacent flattened web member ends wherein each case element includes a planar side portion having an interior edge facing the opposing chord and a flange portion extending normally outwardly from said interior edge;

joining means for joining each of said web cases to adjacent web member ends; and a pair of case-retaining clips, each having a substantially planar flange and a tab extending normal to said planar flange, said tab being sized in width to be clearance receivable in the width of one of the recesses, said planar flange being wider than the recess into which its associated tab is received.

10. The support member of claim 9 wherein said tab has a first portion of sufficient length to extend through the chord and having a second portion of sufficient length to cure said web case to the chord by bending of said second portion over said flange portion.

11. A truss comprising:

an upper and a lower chord disposed in parallel relation having staggered recesses therein, each recess having a predetermined length and width and extending completely through the height of the chord;:

plural elongate web links having flattened ends thereon, arranged diagonally between said chords, with the ends of adjacent links overlapped;

plural web cases located one in each recess and insertable from the side of said chord facing the other said chord, each web case including a pair of opposed case elements wherein each case element includes a planar side portion sized to be received in one of said recesses and having an interior edge facing the opposing chord, and a flange portion extending normally outwardly from said interior edge, one pair of said web links being secured to each web case between said case elements thereof and spacing the said case elements thereof apart from one another to completely fill the width of the recess into which it is received;

joining means for joining each said web cases to adjacent web links; and a pair of case-retaining clips insertable into one of said recesses from a side of said chord facing away from the other said chord, each having a substantially planar flange, said planar flange being located adjacent a recess on the exterior side of a chord, and a tab extending normal to said planar flange, said tab being sized in width to be clearance receivable in the width of a recess.

12. The truss of claim 11 wherein said tab includes a first portion of sufficient length to extend through said chord and having a second portion of sufficient length to secure said case to said chord by bending of said second portion over said flange portion.

13. The truss of claim 11 wherein said case elements are formed from material having a first thickness and said clips are formed of material having a second thickness which is less than that of said first thickness.

14. The truss of claim 11 wherein each side portion has a bore therethrough, said link ends have bores therethrough, and wherein said joining means includes a case pin which is inserted through said bores, said pin being of a length to locate both ends thereof flush with the outer surfaces of said side portions.

15. The truss of claim 14 wherein said pin is swaged into said side portions.

16. The truss of claim 11 wherein said clips are countersunk into said chords such that they are flush with an outer surface thereof.

* * * * *